US006381812B1

(12) United States Patent
Crider et al.

(10) Patent No.: US 6,381,812 B1
(45) Date of Patent: May 7, 2002

(54) OUTDOOR TABLECLOTH SECURING DEVICE

(76) Inventors: Jane Crider; Michael Ray Crider, both of 133 Tower, Verona, KY (US) 41092

( * ) Notice: Subject to any disclaimer, the term of this patent is extended or adjusted under 35 U.S.C. 154(b) by 0 days.

(21) Appl. No.: 09/425,754

(22) Filed: Oct. 22, 1999

(51) Int. Cl.[7] ..... A44B 21/00; A47B 13/11; B65D 63/00

(52) U.S. Cl. ..... 24/306; 300/265 C; 300/442

(58) Field of Search ..... 24/306, 300, 442, 24/482, 265 C

(56) References Cited

U.S. PATENT DOCUMENTS

| | | | | | |
|---|---|---|---|---|---|
| ,562,114 | A | * | 6/1896 | Benford | 24/300 |
| 1,720,295 | A | * | 7/1929 | Schwartzman | 24/300 |
| 2,242,737 | A | * | 5/1941 | Alfreds | 24/67.11 |
| 3,279,008 | A | * | 10/1966 | Wallach | 24/306 |
| 3,727,272 | A | | 4/1973 | Rhodes | |
| 3,960,193 | A | | 6/1976 | Davis | |
| 4,158,905 | A | | 6/1979 | O'Leary | |
| 4,627,363 | A | | 12/1986 | Jones | |
| 4,705,084 | A | | 11/1987 | Rodebaugh et al. | |
| 4,708,183 | A | | 11/1987 | Figueroa | |
| 4,877,288 | A | | 10/1989 | Lee | |
| 4,883,001 | A | | 11/1989 | Roth | |
| 4,905,611 | A | | 3/1990 | Jung-Chung | |
| 5,072,470 | A | | 12/1991 | Lysiak | |
| 5,084,321 | A | | 1/1992 | Sui et al. | |
| 5,086,543 | A | * | 2/1992 | Mitchell | 24/442 |
| 5,215,333 | A | * | 6/1993 | Knight | 24/306 |
| 5,230,767 | A | * | 7/1993 | Taylor | 24/442 |
| 5,377,391 | A | | 1/1995 | Foster | |
| 5,970,585 | A | * | 10/1999 | Scholey | 24/300 |

* cited by examiner

*Primary Examiner*—Victor N. Sakran
(74) *Attorney, Agent, or Firm*—R. Christian Macke

(57) ABSTRACT

A device and method for securing a tablecloth to a picnic table. Multiple strips of elastic with hook and loop type fasteners at opposed ends of each strip, which provide releasable closure of the strips into binding bands, wrap around the tablecloth and secure it to the picnic table. The releasable closure means allow the strips to be threaded through and under the supporting framework for a table or other article of furniture. The strips are sized and constructed for application to a wide range of different sized tables and other outdoor furniture.

10 Claims, 3 Drawing Sheets

OUTDOOR TABLECLOTH SECURING DEVICE

FIELD OF THE INVENTION

The present invention relates to an apparatus and method for securing outdoor tablecloths.

BACKGROUND OF THE INVENTION

Tablecloths for outdoor tables, such as picnic tables, have problems associated with them that are well known, the most recurrent problem being that wind gets under the tablecloth, or some portion of it, and causes it to become displaced from the table or disarranged. It is particularly frustrating when trying to set out a meal to have the tablecloth continually blown off the table. As a result, often the first order of business is for the user to strategically position weights at the corners on the tablecloth to hold it in place. A problem persists even after positioning the weights, however, because overhang portions of the tablecloth that hang down from the table are still subject to being disrupted by the wind. If the weights, which are often nothing more than bottles of ketchup and jars of mustard or other picnic basket type items, are insufficient, the tablecloth and weights are still subject to being disrupted by a strong wind.

As the mobility and recreational activities of the population at large has increased in the past several decades, the number of people travelling recreationally and experiencing the problems associated with wind disrupting tablecloths used on outdoor tables, such as picnic tables and the like, has increased as well. The problem of wind upsetting tablecloths is particularly acute where wind conditions are severe, such as in coastal areas or on lake fronts. Because picnic areas are often intentionally constructed near the beach or lake fronts for aesthetic reasons, the problem and need for a solution is heightened. Differing widths, lengths, thicknesses and type of material used (wood, plastic, concrete, etc.) to construct picnic tables have made it difficult to develop a solution that accommodates all picnic tables.

A number of previous attempts to solve the problem associated with wind disruption of outdoor tablecloths are disclosed in the prior art. However, those solutions lack the flexibility and simplicity of the present invention and are not generally applicable to accommodate different sizes, types and arrangements of picnic tables.

One prior solution is disclosed in U.S. Pat. No. 3,960,193 wherein an apparatus comprising a tablecloth having weights disposed along its periphery is provided. Specifically, the weights are sewn into a sleeve provided in the hem of the tablecloth so that, as the tablecloth lays draped over the table, opposing weights hanging down on both sides of the table hold it in place.

U.S. Pat. No. 4,627,363 provides another solution including strips that are releasably attached to opposed edges of the tablecloth using clamps or snaps. The strips are clamped or hooked under the table between the downwardly extending flaps of the tablecloth to hold the tablecloth in place.

U.S. Pat. No. 4,158,905 provides metal clamps that hold a tablecloth in place on a picnic table by utilizing the spring of the metal to engage picnic tables of certain thicknesses. The clamps are applied near the corners of the table to hold the tablecloth in place. A significant disadvantage with this device is that it is applicable to only a limited number of picnic tables having a table top of the proper thickness.

U.S. Pat. No. 4,883,001 provides a rigid plastic cover for outdoor picnic tables having channels to engage the sides of the picnic table top. This device lacks the flexibility to accommodate picnic tables of different widths and, the construction of the rigid plastic cover makes it much more difficult to transport than a fabric tablecloth that can be folded and easily transported in the glove compartment of an automobile.

Other prior art devices for holding fabric to a piece of furniture, including bedspreads and lounge chair covers, have provided for elastic gathering sewn into an underside perimeter of the tablecloth to gather the tablecloth under the table, or a similar type drawstring gathering mechanism. Still others have disclosed the use of pockets sewn into the corners or periphery of the fabric cover that engage opposing corners or ends of the furniture to which it is attached.

All of the prior art devices require either inclusion of the securing device to or within the tablecloth itself, or are limited in application to specific sizes and arrangements of picnic tables. There is thus identified a need for a device for securing a tablecloth to an outdoor table, such as a picnic table, that is adjustable to accommodate a variety of different sized tables and can be used with wood or concrete tables of any length.

It is also contemplated that the device provided herein can also be used to secure other outdoor furniture fabric covers that may be affected by wind conditions to outdoor furniture, such as towels on lawn chairs or beach chairs and bench and seat covers.

OBJECTS OF THE INVENTION

It is an object of the present invention to provide a device that simply and effectively secures a flexible fabric tablecloth to an outdoor table, such as a picnic table, without any modification of the tablecloth required.

It is another object of the present invention to provide a tablecloth securing device that is adaptable to fit various sized picnic tables.

It is a further object of the present invention to provide a securing device that snugly holds a tablecloth to a picnic table without requiring any permanent attachment.

It is yet another object of the present invention to provide a tablecloth securing device that can be applied to and secure the tablecloth at various positions along the length of a rectangular picnic table.

It is a further object of the present invention to provide a flexible tablecloth securing device constructed from elastic with a simple closure means that wraps around a picnic table and tablecloth to secure the tablecloth to the table.

It is yet another object of the present invention to provide a flexible elastic device for securing a tablecloth to an outdoor table that is adjustable by varying the amount of overlap between a hook-and-loop type connector to adjust for the size of the outdoor table.

It is another object of the present invention to provide a method whereby a fabric tablecloth is secured to a picnic table through the use of elastic binding bands with releasable closure means.

It is also an object of the present invention to provide a device for securing a sheet of fabric to an article of furniture that has a releasable closure means.

These and other objects of the present invention are satisfied by the preferred embodiments of the invention described in more detail herein. These objects are intended to be illustrative and not limiting. The manner of operation, novel features and further objects and advantages of this invention may be better understood by reference to the description and drawings set forth herein.

SUMMARY OF THE INVENTION

The present invention provides a device for securing a tablecloth to an outdoor table, such as a picnic table, comprising a strip of stretchable and resilient fabric with cooperating closure means at opposing ends of the strip. The strip is of a length adequate to wrap around various size picnic tables when stretched.

The cooperating closure means of the most preferred embodiment of the present invention is provided by sections of hook and loop type fasteners affixed at opposed ends of the strip. To apply the device to secure a tablecloth to a picnic table, the strip is threaded over and under the picnic table and stretched as required to create an overlap between a section of hook-type fasteners affixed to one end of the strip and a section of loop-type fasteners affixed to the opposite end of the strip. The section of hook-type fasteners and section of loop-type fasteners are then meshed together to form the strip of stretchable fabric into a binding band encircling and snugly holding the tablecloth to the picnic table.

In the most preferred embodiment of the present invention, the strip of fabric is made from elastic and is two (2") inches wide and fifty-six (56") inches long in the most preferred embodiment. The elastic stretch characteristic of the strip is one-to-two so that it may be stretched up to twice its unstretched length allowing the strip to be used to secure a tablecloth to picnic tables ranging in size from twenty-four (24") inches wide to forty-eight (48") inches wide. In the most preferred embodiment of the present invention, the strip comprises thirty-two percent (32%) rubber and sixty-eight (68%) polyester.

The principles of the present invention contemplate that the securing device disclosed herein is adaptable to be used to secure other kinds and types of fabric to articles of furniture to resist displacement by wind. The use of strips of resilient, stretchable fabric with cooperating closure means is specifically contemplated for use to secure a beach towel to a lounge chair or seat cover to a chair.

The resilient, stretchable fabric of the present invention comprises a strip of sufficient width to prevent slippage over the tablecloth or fabric to which it is applied. The frictional resistance of the wide strip prevents such slippage.

The present invention also provides a method for securing a tablecloth to a picnic table by providing multiple resilient, stretchable strips, positioning a tablecloth over a picnic table and wrapping the strips around the tablecloth. The strips are then stretched around the tablecloth and secured to provide binding bands that snugly secure the tablecloth to the picnic table.

DETAILED DESCRIPTION OF THE INVENTION

Figure 1:
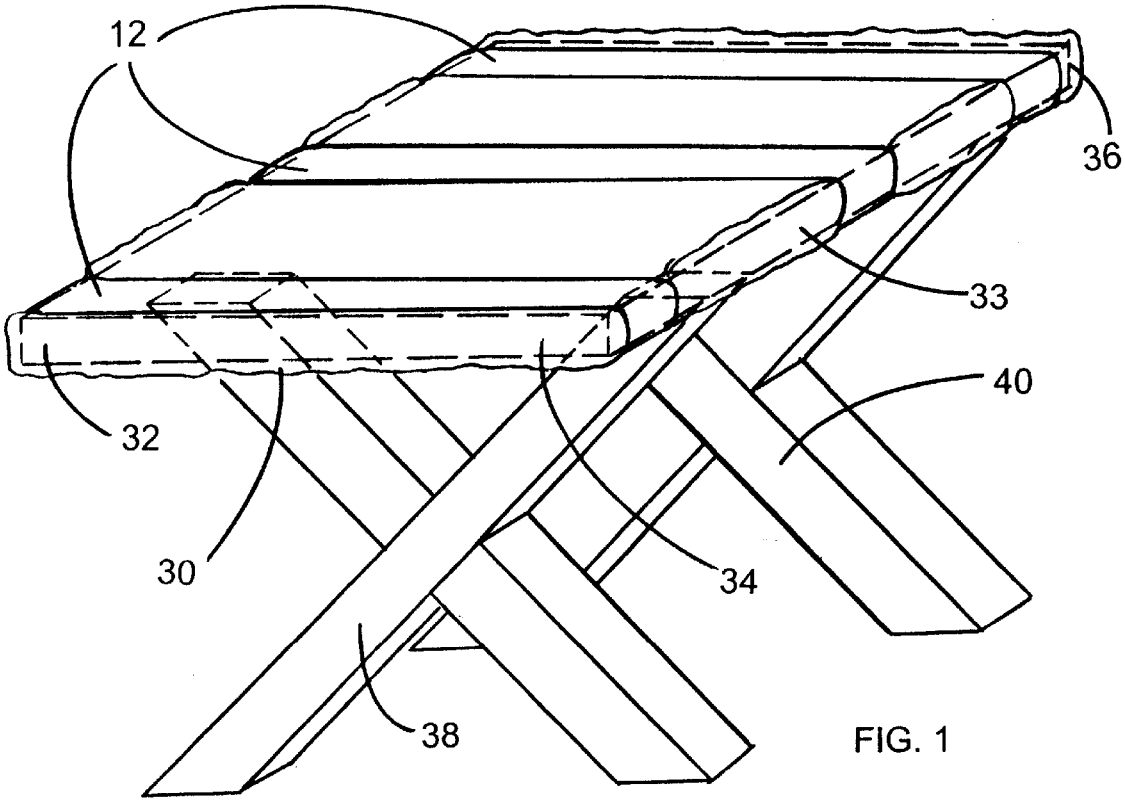
FIG. 1 is a perspective view showing application of multiple elastic strips to hold a tablecloth in place on a picnic table.
Figure 2:
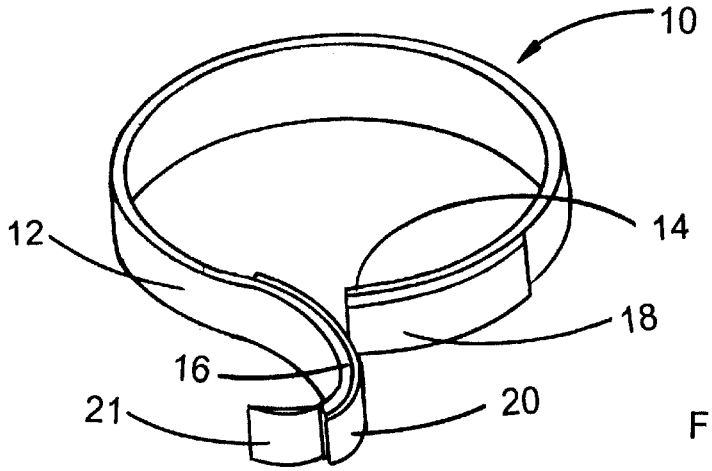
FIG. 2 is a perspective view of an unapplied picnic tablecloth securing device in accordance with the principles of the present invention.

A picnic tablecloth securing device 10 is disclosed wherein a strip 12 of resilient, stretchable fabric having a first opposed end 14 and second opposed end 16 is provided. A releasable cooperating closure means for closing the strip 12 to form a binding band is provided by a hook-type fastener section 18 at the first opposed end 14 and a loop-type fastener section 20 at the second opposed end 16. When the strip 12 is closed to form a binding band, a grip tab 21 adjacent to the second end 16 provides a convenient and accessible opening means for a user to grab the strip 12 to release the loop-type fastener section 20 from the hook-type fastener section 18.

As shown in FIG. 1, multiple strips 12 are utilized to secure a tablecloth 30 to an outdoor picnic table 32. The strips 12 are provided as elongated strips 12 with releasable cooperating closing means rather than a continuous loop so that each strip 12 may be readily threaded under the picnic table top 33 between downwardly depending legs 38, 40.

At least two (2) strips 12 are preferably applied near the ends 34, 36 of the picnic table 32, although the strip 12 of the present invention may also be applied at other points along the length of the picnic table 32 by wrapping the strip 12 and securing the closure means 18, 20 by meshing the hook-type fastener section 18 and loop-type fastener section 20 together.

Figure 3:
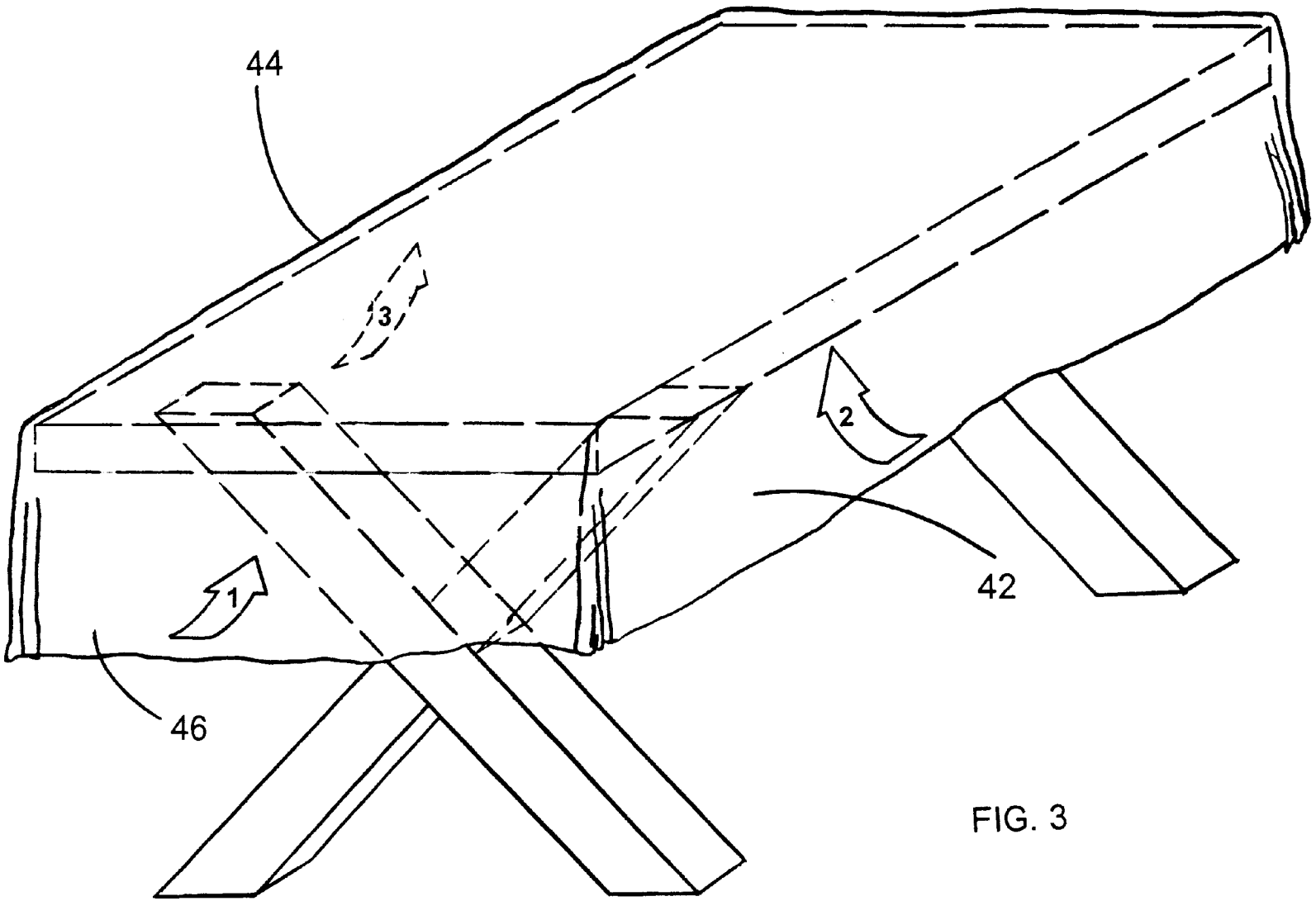
FIG. 3 is a perspective view showing a picnic table with a tablecloth draped over it illustrating application of the present invention.
Figure 4:
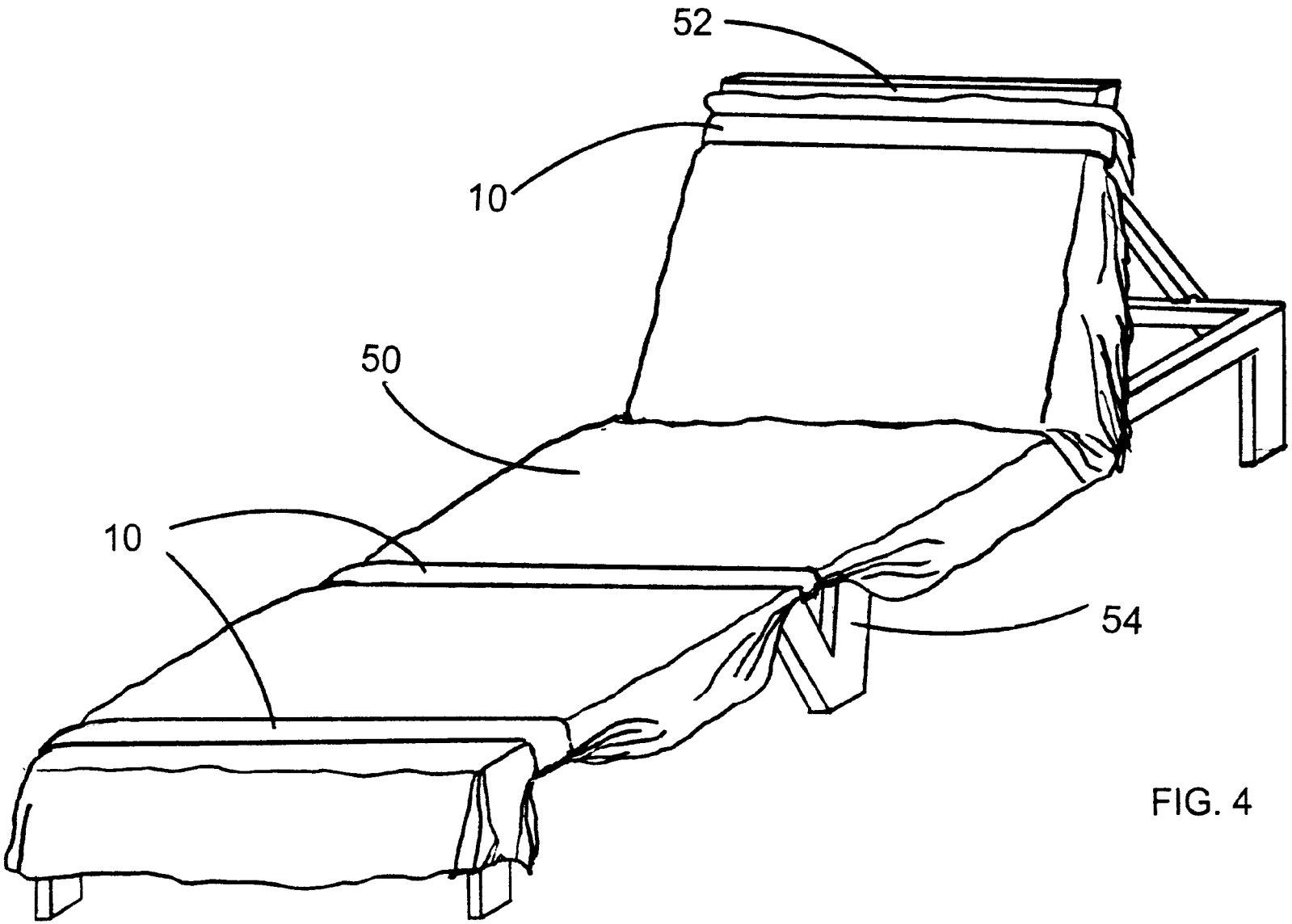
FIG. 4 is a perspective view showing a lounge chair with a towel secured to it with the binding band of the present invention.

To apply the strips 12 to the first end 34 of the picnic table 32, the free hanging side flaps 42, 44 and end flap 46 are gathered and folded up under the picnic table top 33, as illustrated by arrows 1, 2, 3 in FIG. 3. The strip 12 is then wrapped around the tablecloth 30, including the folded side flaps 42, 44 and end flap 46 to snugly secure the tablecloth 30 to the picnic table 32.

The strip 12 is of sufficient width to frictionally resist sliding along the tablecloth 30. In the most preferred embodiment of the present invention, the strip 12 comprises elastic that is two inches (2") wide. The width of the strip 12 is also advantageous because it is very durable, even in its stretched state.

To accommodate various size picnic tables, ranging from picnic tables constructed from wood that have one inch thick table tops to others formed from concrete that have four inch thick table tops, the strip 12 of the present invention comprises fabric that is elastic.

In the most preferred embodiment, the elastic comprises thirty-two percent (32%) rubber and sixty-eight (68%) polyester. The strip 12 comprising such elastic exhibits a 2:1 stretch characteristic in that the strip 12 can be stretched to twice its unstretched length. Thus, when fully stretched, the preferred embodiment of the strip 12 is twice its unstretched length and at least half its original width (1.5 inches). The strip 12 is fifty-six inches (56") long in the preferred embodiment and the length of each of the hook-type fastener section 18 and loop-type fastener section 20 is eight inches. Thus, a strip 12 of these dimensions accommodates a wide range of picnic table sizes, from twenty-four inches (24") wide to forty eight (48") wide. Besides the flexibility afforded by the elastic nature of the strip 12, the amount of overlap between the hook-type fastener section 18 and loop-type fastener section 20 may be varied to alter the length of the binding band formed thereby.

In another application of the present invention, multiple elastic strips 12 are provided to secure a towel 50 to a lounge chair 52. The inclusion of a releasable cooperating closure means comprising a section of hook-type fasteners 18 and a section of loop-type fasteners 20 at the ends of each strip 12 allow the strips 12 to be threaded through the support framework 54 of the lounge chair 52 and engaged by meshing the hook-type fastener section 18 and loop-type fastener section 20 together to transform each strip 12 into a continuous binding band. The towel 50 is secured to the lounge chair 52 by the binding band created from the strips 12. To release the strips 12, a user simply grabs the grip tab 21 and pulls to release the hook-type fastener section 18 from the loop-type fastener section 20.

A method for securing the tablecloth 30 to the picnic table 32 is also provided in accordance with the principles of the present invention. The first step in securing the tablecloth 30 is to provide multiple resilient strips of fabric 12 having releasable cooperating closure devices 18, 20 at opposed ends 14,16. After the tablecloth 30 is positioned over the picnic table 32, the downwardly depending side flaps 42,44 and end flap 46 of the tablecloth 30 are folded up under the picnic table 32, as indicated by directional arrows 1,2,3 shown in FIG. 3. Next, the strips 12 are wrapped around the tablecloth 30 and picnic table 32 and stretched until adequate overlap between hook-type fastener section 18 and loop-type fastener section 20 is obtained. The hook type fastener section 18 is then meshed together with the loop-type fastener section 20 to provide a binding band that secures the tablecloth 30 to the picnic table 32.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

We claim:

1. A device for securing a tablecloth to ends of a picnic table comprising:

at least two strips of resilient stretchable fabric applied near the ends of the picnic table, each of said at least two strips having a first opposed end and a second opposed end;

a releasable cooperating closure means provided at opposed ends of each of said at least two strips; and opening means for releasing said releasable cooperating closure means.

2. The device for securing a tablecloth to a picnic table of claim 1 wherein each of said at least two strips is adaptable to fit tablecloths and picnic tables of different sizes.

3. The device for securing a tablecloth to a picnic table of claim 1 wherein said releasable cooperating closure means comprises hook-and-loop type fasteners affixed to said first opposed end and said second opposed end and said opening means comprises a grip tab.

4. The device for securing a tablecloth to a picnic table of claim 3 wherein a section of hook-type fasteners is provided at the first end of each of said at least two strips an a section of loop-type fasteners is opposed at said second end.

5. The device for securing a tablecloth to a picnic table of claim 4 wherein each of said at least two strips comprises elastic.

6. The device for securing a tablecloth to a picnic table of claim 5 wherein said elastic is two (2") inches wide in its unstretched state.

7. The device for securing a tablecloth to a picnic table of claim 6 wherein said elastic has a one-to-two stretching characteristic.

8. The device for securing a tablecloth to a picnic table of claim 7 wherein said elastic is thirty-two (32%) percent rubber and sixty-eight (68%) percent polyester.

9. The device for securing a sheet of fabric to an article of furniture of claim 8 wherein:

said strip comprises elastic;

said cooperating closure means comprises a section of hook-type fasteners at said first opposed end and a section of loop-type fasteners at said second opposed end.

10. A method for securing a tablecloth to a picnic table comprising the steps of:

providing multiple resilient stretchable strips of fabric having releasable cooperating closure devices at opposed ends;

positioning a tablecloth over a picnic table;

folding downwardly depending side flaps and end flaps of said tablecloth under the picnic table;

wrapping said strips around said folded downwardly depending side flaps and end flaps of said tablecloth;

stretching each of said strips around said tablecloth; and securing each of said cooperating closure devices to provide a binding band to snugly secure the tablecloth to the picnic table.

* * * * *